United States Patent [19]

Workman

[11] Patent Number: 4,685,267

[45] Date of Patent: Aug. 11, 1987

[54] BOX VOID

[75] Inventor: Gary L. Workman, Lombard, Ill.

[73] Assignee: Deslauriers, Inc., Bellwood, Ill.

[21] Appl. No.: 519,087

[22] Filed: Aug. 1, 1983

[51] Int. Cl.[4] ..... E02D 31/14; E04B 5/32

[52] U.S. Cl. ..... 52/577; 52/169.1; 52/576; 229/28 R; 229/15; 249/61; 249/176; 249/DIG. 2

[58] Field of Search ..... 249/1, 2, 13, 31, 32, 249/61, 183, 175, 176, 188, DIG. 2; 229/15, 28 R, 29 B, 29 C, 29 D; 52/576, 577; 405/229; 52/169.1, 98

[56] References Cited

U.S. PATENT DOCUMENTS

| | | | |
|---|---|---|---|
| 1,585,430 | 5/1926 | Smith et al. | 52/577 |
| 1,585,684 | 5/1926 | Oppenheim | 220/441 |
| 1,864,043 | 6/1932 | Gruber | 249/32 |
| 1,892,311 | 12/1932 | MacDonald | 249/175 |
| 2,097,682 | 11/1937 | Anderson | 229/29 D |
| 2,101,019 | 12/1937 | Bowes | 249/18 |
| 2,192,183 | 3/1940 | Deutsch | 264/278 |
| 2,309,147 | 1/1943 | Wilkinson | 52/383 |
| 2,330,345 | 9/1943 | Elliott | 229/28 R |
| 2,693,308 | 11/1954 | Giroux et al. | 229/28 R |
| 2,693,309 | 11/1954 | Giroux et al. | 229/28 R |
| 2,700,499 | 1/1955 | Durand | 229/28 R |
| 2,823,442 | 2/1958 | Miller et al. | 249/178 |
| 2,881,501 | 4/1959 | Raney | 249/175 |
| 2,916,909 | 12/1959 | Miller | 52/323 |
| 3,024,513 | 3/1962 | Shuxteau et al. | 249/134 |
| 3,109,217 | 11/1963 | Kell | 249/176 |
| 3,148,444 | 9/1964 | Stark | 29/455 R |
| 3,238,278 | 3/1966 | Stark | 264/34 |
| 3,358,960 | 12/1967 | Oliver et al. | 249/179 |
| 3,562,979 | 2/1971 | Ali-Oglu | 52/577 |
| 4,108,349 | 8/1978 | Pfaffendorf | 229/15 |

FOREIGN PATENT DOCUMENTS

| | | | |
|---|---|---|---|
| 1066005 | 9/1959 | Fed. Rep. of Germany | 52/577 |

OTHER PUBLICATIONS

"Jay-Voids", Engineering News-Record, Apr. 21, 1960, p. 76.

Savway Carton Forms, Inc. 1240 Profit Drive, Dallas, Texas 75247, "Carton Forms, Custom Forms for Concrete" (6 pages brochure).

Gates & Sons, Inc. 90 South Fox Street, Denver, Colorado 80223, "Gates, Sure-Void", (2 page brochure).

*Primary Examiner*—Jay H. Woo

*Assistant Examiner*—James C. Housel

*Attorney, Agent, or Firm*—Leydig, Voit & Mayer

[57] ABSTRACT

A reinforced fiberboard box for creating a void in and under concrete formations. A single piece of double faced, corrugated fiberboard is defined by a face, a bottom, a pair of end flaps, and a pair of side flaps. The end flaps are folded into at least four uniformly shaped partitions which are subsequently folded onto the face of the fiberboard and are aligned along the longitudinal axis to create a box-like structure. Pairs of side flaps are then wrapped around the sides and top of the partitions to form a completely closed, internally reinforced, box-like structure. A portion of the side flaps are tucked inwardly, intersecting the partitions so that slots in the side flaps interlock with slots in the partitions which prevents the box void from unfolding during use.

1 Claim, 8 Drawing Figures

BOX VOID

FIELD OF THE INVENTION

The invention relates generally to reinforced fiberboard inserts which are used to create voids in concrete formations. More specifically, a single piece of corrugated fiberboard, or similar material, is folded to form a rectangular box-like structure that is placed on a construction site and over which wet concrete will be poured. As the concrete dries, and as the fiberboard eventually deteriorates, a void is left in the concrete formation.

BACKGROUND OF THE INVENTION

In the construction industry, it is often desirable to create voids in various types of concrete formations for several reasons. First, it is often desirable to create voids in a below grade concrete formation which is in contact with the ground so that after the concrete dries, and the box void deteriorates, there will be enough space for the ground to expand, referred to as soil upheaval, thereby preventing damage to the concrete formation. Secondly, it is sometimes desirable to create a void inside of a concrete pillar or column in order to allow room for internal plumbing, electrical conduit, etc., contained inside the column. Such practice does not impair the structural characteristics of the column, but can amount to a considerable savings in the amount of concrete used as well as protecting the items in the column. Finally, box voids can be used above grade between cement floor slabs for the purpose of reducing the amount of cement required for a particular application and to make the resulting slab lighter in case the floor needs to be raised by hydraulic jacks or otherwise.

The prior art contains several different types of inserts used to create voids in concrete formations. For example, U.S. Pat. No. 3,358,960 discloses a reinforcing insert made of corrugated paperboard which is positioned to form a void in a cast concrete structure. The patent shows a single piece of paperboard having numerous flanges, slots, and perforations so that the paperboard can be folded, but it requires numerous complex steps to form a desired shape. In U.S. Pat. No. 2,881,501 there is shown a box-form structure which is capable of receiving a honeycomb reinforcing structure in order to add internal strength to the box void. Generally, the box voids of the prior art are complicated to assemble if they are a single piece of material, or require inserts to be added after the box form is completed to increase the internal strength of the box form. Either type is generally difficult to assemble on site and is costly in terms of manhours.

SUMMARY OF THE INVENTION

It is an object of the present invention to provide a reinforced fiberboard insert for creating a void in a cement formation located below grade to allow for soil expansion within the void area and thereby protect the concrete formation from damage.

It is another object to provide a reinforcing insert for creating a void in a cement formation located above grade so that the cement formation is lighter in weight in the event that such formation must be raised by hydraulic jacks or other means.

Another object is to provide a reinforcing insert for creating a void in a concrete formation where the insert is comprised of a single piece of corrugated fiberboard which can be easily assembled by untrained laborers at the construction site, without the use of adhesives, staples, or other fastening means.

It is a further object to provide a reinforcing insert for creating a void in concrete formations whereby the insert has sufficient vertical and lateral strength due to internal partitions so that it maintains its box-like form under the substantial weight of wet cement and reinforcing steel rods.

Other objects and advantages of the invention will become apparent upon reading the attached detailed description and upon reference to the drawings, in which.

Figure 7:
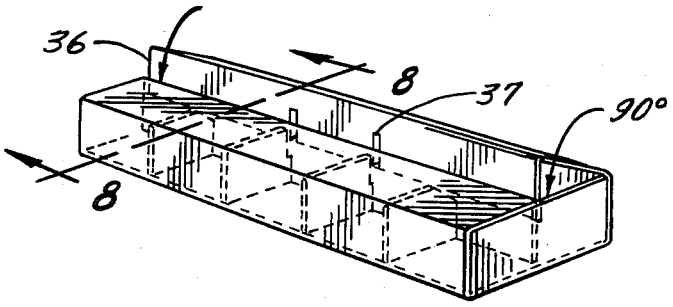
Figure 8:
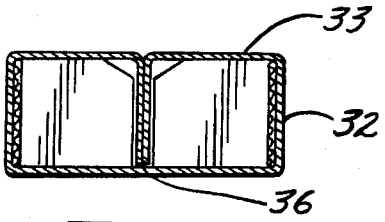

FIG. 7 is a perspective view of the reinforced insert with one side flap wrapped around the partition, a portion of said side flap being inserted into the partition, while the other side flap is depicted just before it is to be inserted into the partition to lock and seal the box closure; and FIG. 8 is a cross-sectional view taken along line 8—8 of FIG. 7 showing a box void in its folded condition.

While the invention has been described in connection with certain preferred embodiments, it will be understood that it is not intended that it be limited to the embodiment shown but it is intended, on the contrary, to cover the various alternative forms of the invention included within the spirit and scope of the appended claims.

DETAILED DESCRIPTION OF THE INVENTION

Figure 1:
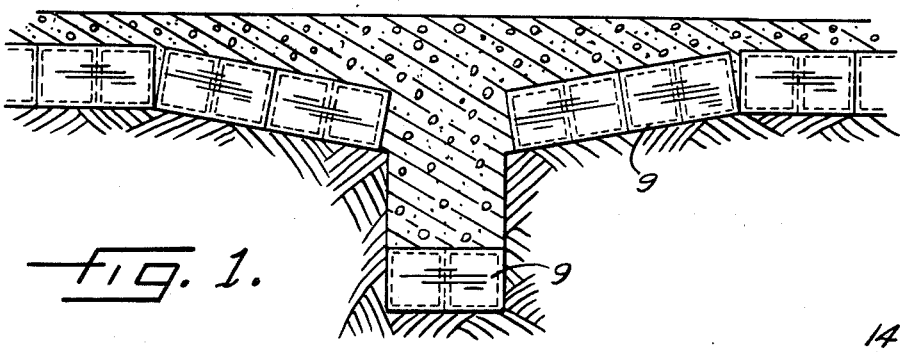
FIG. 1 is a cross-sectional view of a cement foundation having a series of box voids positioned along the ground in the floor area, and a single box void positioned below the footing.

Turning to FIG. 1 there is shown a series of assembled box voids 9 aligned and resting between the ground and a portion of wet concrete. A single box void 9 is positioned between the ground and the concrete footing. Preferably, the box voids 9 are to be pushed tightly together before the concrete is poured to prevent the concrete from seeping in between the box voids and creating an uneven void area. After the concrete dries the box voids 9 will eventually deteriorate and there will be void area between the ground and the concrete.

Figure 2:
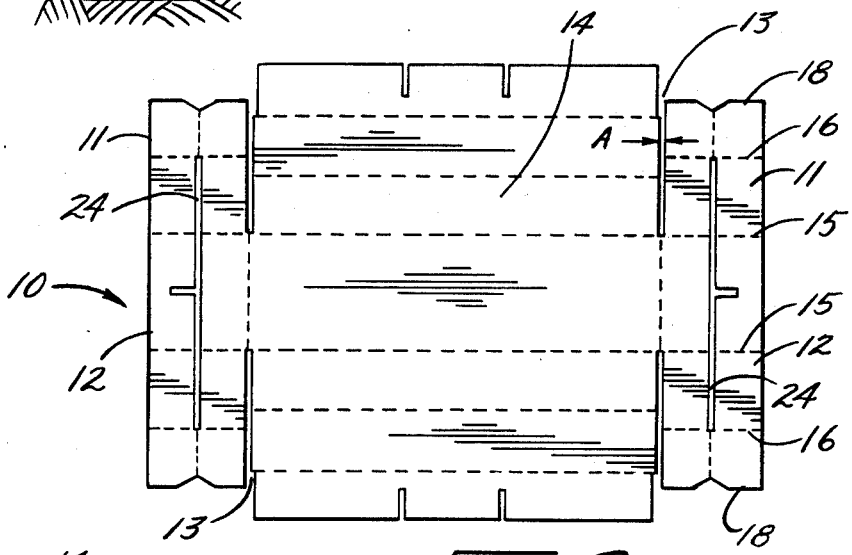
FIG. 2 is a layout view of a reinforced fiberboard insert showing the face, the end flaps, the side flaps, and the T-slots located in each end flap.

To construct a box void 9 from a blank as shown in FIG. 2, a single piece of corrugated fiberboard 10 is depicted in a flattened condition and before it is folded to form a box-like structure. It is intended that the fiberboard 10 be shipped in its unfolded condition to the construction site where it is then easily folded into a box void. Generally the fiberboard 10 is double faced and is impregnated with wax and then laminated with a moisture resistant adhesive so that it can resist the absorption of moisture from wet concrete as the concrete is drying. In resisting moisture absorption the box void retains its structural integrity until the contrete is completely dry. Materials other than the above-identified fiberboard may also be used for constructing a box void as long as the material maintains its structural integrity while the concrete is drying.

Figure 3:
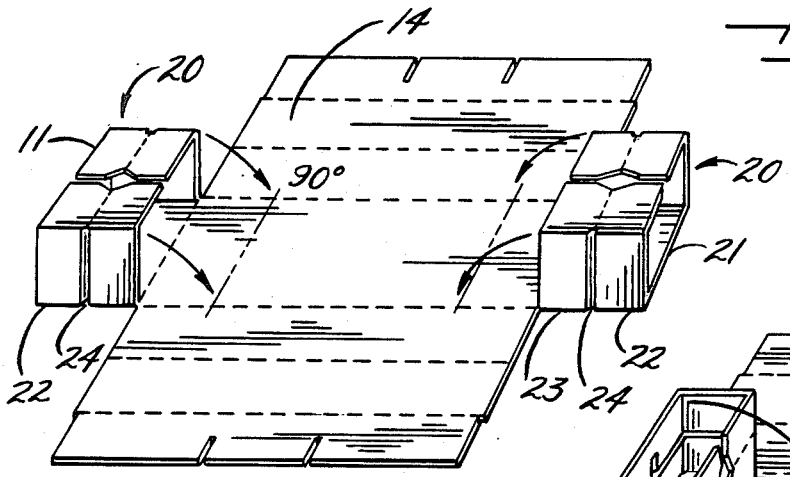
FIG. 3 is a perspective view of the reinforced insert after the side flanges have been folded to form partitions.
Figure 4:
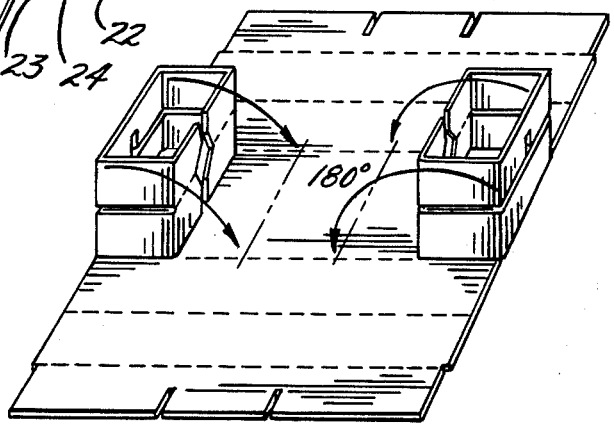
FIG. 4 is a perspective view of the reinforced insert after the partitions have been folded inwardly toward each other.

For the purpose of increasing the internal strength of the box void several partitions are created by folding a pair of end flaps 11 and turning the resulting partitions inward in line. More particularly, each end flap 11 has a side flange 12 which is separated a distance A by slot 13 from the face 14 of the fiberboard. Slot 13 is required to prevent bunching of the fiberboard as it is folded. Side flange 12 is folded 90° at first score line 15 and subsequently folded 90° at second score line 16 so that the ends 18 of the side flanges 12 are nearly touching one another, as is shown in FIG. 3. In this position it is seen that the side flanges 12 have been folded to form a set of box-like partitions 20.

The partitions 20, in the form of rectangular columns 21, are rotated inwardly 90° to form an upper partition 22 and a lower partition 23. The two partitions are separated by a T-slot 24 (see FIG. 2) to facilitate the rotation of the upper partition 22 by 180° so that it comes to rest on the face 14 of the fiberboard.

Figure 5:
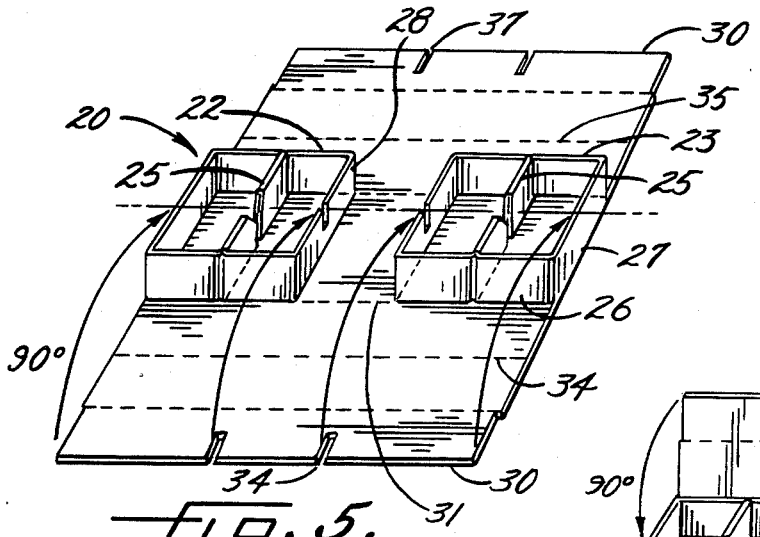
FIG. 5 is a perspective view of the reinforced insert where the upper partitions are folded 180° along the T-slot so that four equal partitions are aligned along the longitudinal axis of the insert.
Figure 6:
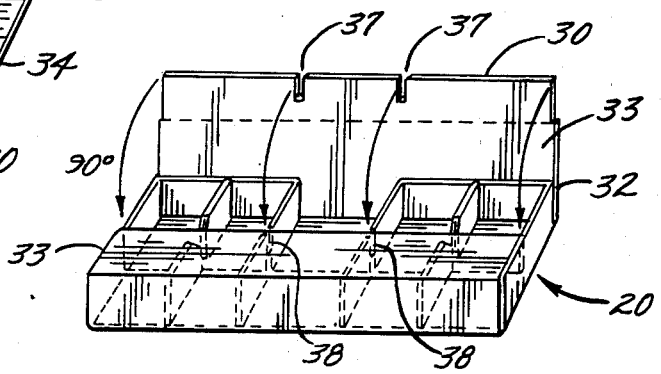
FIG. 6 is a perspective view of the reinforced insert with the side flaps folded 90° along the sides of the partitions.

As shown in FIG. 5, the upper partition 22 and the lower partition 23 share a common double thickness wall 25 which does not extend all the way across the partitions yet lends considerable lateral stability to the box void. In this configuration, there are four uniformly shaped partitions 20 extending along the longitudinal axis of fiberboard 10, the walls 25, side walls 26, end walls 27, and inner walls 28 of the partitions provide the vertical and lateral stability of the box void.

To completely enclose the partitions 20, a pair of side flaps 30 are bent 90° along score lines 31 to form a double thickness of side wall 32 in the area of the partitions 20. With a double thickness sidewall along the partitions 20, the vertical strength of the box void is substantially increased.

To provide a closure for the spaces defined by the partitions 20 and to lock in place the side flaps 30, top flaps 33 are folded 90° along score lines 34 and score lines 35. The edge 36 of top flaps 30 have a pair of slots 37 which interlockingly engage slots 38 in upper partitions 22. As the edges 36 are folded 90°, they are tucked into and downward toward partitions 20 so that slots 37 interlock with slots 38 to lock the side flaps 30 in place (see FIG. 7).

It is intended that the box voids be positioned side-by-side with no space between the boxes so that wet concrete does not run down between the boxes. As shown in FIG. 8, the several thicknesses of sidewall provide the box voids with sufficient vertical strength to hold steel reinforcing rods placed thereon, as well as the wet concrete poured over the box voids. The wax impregnated fiberboard resists absorption of moisture from the concrete as the concrete dries and hardens. After a period of time the box voids will eventually deteriorate, leaving a void in the hardened concrete. The number of box voids used for any particular application will depend upon the size of the void required, whether the location is above or below grade, and the weight of concrete and steel rod placed on the box voids.

For example, a single box void, when assembled, may be 6 inches high, 12 inches wide, and four feet long. By placing box voids side-by-side, stacking them, or placing them end-to-end, one can vary the size of the void created. The particular dimensions used above are for illustrating the example given and are not intended as a limitation. It is contemplated that assembled box voids will range in size from 6, 8, 10 and 12 inches in width, 4 or 6 inches high, and up to 8 feet long.

When using the word "blank" in the claims it is meant that the reinforced fiberboard insert is in the unfolded state with all the necessary score lines and slots already impressed therein.

I claim as my invention:

1. In combination with a concrete formation having a void area, a reinforced box-like structure incorporated in said void area, said box-like structure comprising an assembled blank having a top, a bottom, a pair of end flaps each having a T-slot, a pair of side flanges, and transverse score lines positioned thereon, a pair of side flaps each having a plurality of slots on their outer edges, and a face, said end flaps being folded into uniformly shaped partitions by folding said side flanges 90° along a first score line and 90° along a second score line, said partitions being divided into a pair of upper partitions and a pair of lower partitions with said T-slot located therebetween, said upper partitions being folded inwardly toward each other to create four structurally uniform partitions aligned along said face of said reinforced insert, each pair of upper partitions being interconnected to said lower partitions by a common double thickness wall, said face forming the bottom of said partitions while said side flaps are folded to form the top of said partitions, said side flaps being folded inwardly to intersect said partitions, said slots of said side flaps matingly engaging said T-slots of said end flaps in an interlocking manner when said side flaps are folded inwardly toward said partitions to form a closure around said partitions so that the completed structure can be assembled at a construction site.

* * * * *